United States Patent [19]

Strong

[11] Patent Number: 5,002,438

[45] Date of Patent: Mar. 26, 1991

[54] METHOD OF REHABILITATING MANHOLES BY CUSTOM LINING/RELINING

[76] Inventor: William A. Strong, Rte. 12, P.O. Box 1150, Brinkley Rd., Pine Bluff, Ark. 71603

[21] Appl. No.: 460,652

[22] Filed: Jan. 3, 1990

[51] Int. Cl.[5] ..... E02D 29/12

[52] U.S. Cl. ..... 405/303; 405/133; 405/268

[58] Field of Search ..... 405/150, 154, 266, 267, 405/303, 133, 268; 52/20, 744; 138/97; 264/31, 32, 36

[56] References Cited

U.S. PATENT DOCUMENTS

| | | | |
|---|---|---|---|
| 2,484,018 | 10/1949 | Crom | 25/38 |
| 2,894,539 | 7/1959 | Cook et al. | 138/97 |
| 3,269,421 | 8/1966 | Telford et al. | 138/97 |
| 3,672,173 | 6/1972 | Paramore et al. | 405/266 |
| 3,708,124 | 1/1973 | Kellert | 239/426 |
| 3,774,683 | 11/1973 | Smith | 405/266 X |
| 3,834,433 | 9/1974 | Thompson | 141/392 |
| 3,871,583 | 3/1975 | Kellert | 239/302 |
| 4,181,484 | 1/1980 | Kostylev et al. | 425/59 |
| 4,245,970 | 1/1981 | St Onge | 425/13 |
| 4,325,772 | 4/1982 | Suetoshi et al. | 156/294 |
| 4,350,548 | 9/1982 | Zenbayashi et al. | 156/156 |
| 4,370,113 | 1/1983 | Nakashin | 425/13 |
| 4,386,628 | 6/1983 | Lachaux | 138/30 |
| 4,456,401 | 6/1984 | Williams | 405/150 |
| 4,601,312 | 7/1986 | Parkyn, Sr. | 138/97 |
| 4,602,659 | 7/1986 | Parkyn, Sr. | 138/98 |
| 4,678,370 | 7/1987 | Allen | 405/154 |
| 4,695,188 | 9/1987 | Paulkkinen | 405/150 |
| 4,728,223 | 3/1988 | Rice | 405/154 |
| 4,751,799 | 6/1988 | Ditcher et al. | 52/21 |
| 4,769,077 | 9/1988 | Crocker | 106/90 |
| 4,772,327 | 9/1988 | Allemann et al. | 106/90 |
| 4,777,905 | 10/1988 | Lona | 118/105 |
| 4,781,556 | 11/1988 | Paul | 425/62 |
| 4,796,669 | 1/1989 | St. Onge | 138/97 |
| 4,796,814 | 1/1989 | Klemm et al. | 239/430 |
| 4,818,314 | 5/1989 | Brittain et al. | 156/87 |
| 4,846,147 | 7/1989 | Townsend et al. | 126/307 R |

OTHER PUBLICATIONS

"ACI Standard Recommended Practice for Shotcreting" (ACI-506-66); American Concrete Institute, 1966, pp. 506-1 to 506-22.

U.S. Dept. of HUD, "Utility Infrastructure Rehabilitation", Nov. 1984, pp. 5-1 to 5-16 and 5-55 to 5-61.

*Primary Examiner*—David H. Corbin

*Attorney, Agent, or Firm*—Stephen D. Carver

[57] ABSTRACT

A method for lining or relining a sewer manhole, apparatus comprising an improved leak resistant manhole, and a cementitious mixture for lining/relining manholes. A homogeneous, monolithic, cementitious liner is spray applied in place within a concrete or brick-and-mortar manhole infrastructure without forms, webbing, or re-bar. A manhole to be serviced is first located and spray cleaned with water. Loose concrete and mortar fragments of the original structure are forcibly removed. A cementitious mixture is spray-applied to the interior surfaces of the manhole to create a continuous, monolithic interior liner. This lining is configured substantially identically to the internal shape and geometry of the manhole. When the liner sets after installation, a substantially impervious water and chemical resistant barrier prevents manhole ingress/egress by ground water. The preferred cementitious mixture is a lightweight, high silicate, fiber-reinforced blend, which, when mixed with 20% to 40% water by weight and properly spray applied, will produce a monolithic liner having hitherto undiscovered geometric and structural strength characteristics, including improved water impermeability and chemically resistant properties. The disclosed structure and process contribute positively to the promotion of improved sewer system integrity.

4 Claims, 3 Drawing Sheets

METHOD OF REHABILITATING MANHOLES BY CUSTOM LINING/RELINING

BACKGROUND OF THE INVENTION

This invention relates generally to maintenance and repair of sewer system manholes. More particularly, the invention relates to an improved method of lining or relining manholes to reinforce, seal and rehabilitate them.

In todays' efforts to clean up our environment and minimize pollution, it has been mandated by the Environmental Protection Agency that cities must stop the flow of sewage into streams, lakes, rivers and oceans. The overloading of modern sewage systems is caused by several factors, including the growth of our cities, and the inevitable aging of sewer systems, and the poor quality associated with installation of new systems. The deterioration of associated manholes is a major cause for alarm.

Complex sewer utilities comprises a variety of interconnected lines, pumping stations, conduits and the like. Municipal sewers typically comprise a plurality of networked, generally horizontally extending underground lines which are generally, but not always, built adjacent to and beneath the street network. These sewers include horizontal, subterranean lines formed of longitudinally aligned sections of slightly inclined pipes, which terminate periodically within manholes. A manhole is essentially a vertical passageway, typically beginning at ground level or at the street surface, which extends into the ground and receives one or more sewer line junctions. Manholes enable human access to line junctions and installations, for system inspections, maintenance and repairs.

Typical manholes are formed of bricks, tiles or concrete blocks bonded together with cement mortar, built via a plurality of construction techniques. Pre-cast and "cast in place" concrete manholes are also common. The chimney structure may be of uniform diameter at the manhole top, but usually the structure diverges downwardly towards a non-uniform lower volume adjacent to the sewer invert. The sewer pipes connect at the bottom of the manhole entryway through an exposed, open-air invert which permits human access to the sewer pipeline system.

As will be readily appreciated by those skilled in the art, numerous problems are experienced by sewer systems as time goes on. For example, joints eventually leak, and pipe lines may become broken or discontinuous. In addition, debris may collect and jam the system, and tree roots, which are drawn to the nutrient rich sewer lines, will eventually cause cracking and interrupting sections of the system. Many of the issues involved in sewer maintenance and repair are discussed in detail in a publication entitled *Utility Infrastructure Rehabilitation,* published by the United States Department of Housing and Urban Development, Office of Policy Development and Research, Building Technology Division, November 1984, which is hereby incorporated by reference.

While it will be recognized that numerous problems can occur to the sewer pipelines themselves, other urgent problems primarily relating to water seepage and leaking, infect conventional manhole structures. Overloading from inflow and infiltration caused by rains is serious. Run-off goes directly into typical manholes. This inflow and infiltration causes flooding of the system and overloading of "downstream" treatment plants, and as a result raw sewage can be discharged directly into the environment by way of the drainage system, much of which is above ground. Such inflow and infiltration will increase the flow in the system as much as ten times in some instances and an increase of three to four times is not uncommon. Studies have shown that as much as 75% of the inflow during rainy periods is through the manholes and the remaining 25% is through the transport lines between each manhole. Of course exfiltration is dangerous as well.

Many of our sewage systems are fifty years old or older. All of the older systems were built with brick or block with mortared joints. With the deteriorations of the bricks and mortar, many of these old manholes have partially or completely collapsed, and they allow ground water to pass freely into the gathering system. Older manholes which are not on the verge of outright structural collapse usually leak severely, and thus contribute significantly to water infiltration and downline system overflow. As the brick, concrete, concrete block and mortar combination tends to decay, the entire system may practically fall apart. Ground water can leak around and through the loose bricks, tiles, blocks, concrete or mortar and penetrate the manhole, dropping onto the invert and entering the sewer system. Surface water or drainage can occur around the manhole ring. Concrete manholes allow infiltration and/or exfiltration as a result of honeycombing, cold joints, or improperly sealed joints.

Thus ground water and flash flood or surface water, for example, typically can enter a sewer system through and around leaks in the manhole structure, quickly overfilling the lines. This flood water will quickly overpower the system, and cumulative over-pressure transmitted to a downline manhole may result in a vertically upwardly movement of water which will deflect the manhole cover and scatter untreated sewage directly upon the streets above.

This excess water, which would not require municipal treatment but for its entry into the sewer system, flows to the treatment facility resulting in unnecessary treatment cost. Also, the excess exceeds the design capacity of the typical treatment plant, resulting in inadequately treated sewage, and the discharge of offensive effluent into streams, lakes, rivers and oceans.

A reliable and cost-efficient system to restore and maintain manhole structural integrity for stopping the inflow and/or infiltration/exfiltration of water through the sewer system, or raw sewage out of the system, is thus necessary.

While it has long been appreciated that periodic maintenance and rehabilitation activities must be conducted for proper sewer utility administration, the necessity of proper manhole maintenance has not been emphasized. In the prior art it is known to patch leaks in manhole brick, concrete block and concrete structures through the application of chemical grouting. Grouting is a method often used to seal leaking joints and circumferential cracks in non-pressure pipelines, such as sewer pipes. The principal chemical grouts currently available are acrylamide gel, acrylate gel, urethane gel and polyurethane foam. Foam grouts form an in place pipeline type of gasket and can cure to a tough flexible and cellular, rubber-like material. A seal is created within the joint with minimum penetration of the material to the outside of the joint or pipeline. Gel grouts, on the other hand, penetrate to the outside of the joint and pipeline, both filling the joint and forming an external seal as it mingles with the soil and fills voids outside the joint. The grout and soil mixture cures to a relatively impermeable and somewhat flexible collar within and on the outside of the joint.

The most commonly used gel grouts are acrylamide gel, acrylate polymer and urethane gel. All are resistant to the chemicals found in sewer lines. Foam grouts are liquid urethane prepolymers which are catalyzed by water during injection. Immediately upon injection, the foaming reaction of the grout and water, together with the injection pressure, expands the material into the joint cavity. Foam grouts, sometimes called elastomeric grouts, are difficult to apply. Chemical grouts are also used, but they have no structural properties capable of insuring an effective seal where joint or circumferential cracking problems are due to on-going settlement or shifting of the pipeline. Additionally, there are concerns about the effects of these products on our environment.

As recited in the aforementioned publication, *Utility Infrastructure Rehabilitation,* pages 5–57 through 5–58, there exists three common methods which are used for rehabilitating manhole structures. It is known to apply coating to the interior wall of the manhole, and coatings can be made of epoxy, acrylics, polyurethanes etc. They may be applied directly over brick, tile, concrete block or concrete and to a certain extent they are waterproof and corrosion resistant. Typically an epoxy coating is applied by troweling. Acrylic coatings are applied with a brush and polyurethane coatings have been applied with an airless sprayer. For repairs, the surface of the manhole must be clean and free of debris. Generally a structurally sound manhole is required and rinsing and cleaning through detergents and various forms of cleaning solutions may be necessary. Proper surface cleaning is critical, and the surface must be allowed to properly dry for certain types of coatings such as polyurethane. In general all leaks must be plugged using patching or grouting materials. Usually quick drying grouts are used and they are troweled into place. It is known to employ cement patches, polyurethane foam and a variety of chemical grouting materials to stop leaks.

Chemical grout may also be applied about the buried exterior of manholes. Large volumes may be pumped into the usually irregular and unpredictable void between the outside of the manhole and the surrounding ground. A non-homogeneous irregular and inconsistent mixture which results is incapable of "sealing" a manhole even after curing of the chemical material. This method may be used to reduce infiltration through cracks and holes, but an economically excessive volume of grout is usually needed in these circumstances. Since its volume cannot adequately be determined prior to application, its use is unfavored.

Finally it is also known to insert a structural liner inside an existing manhole. The liner must conform to the configuration of existing manhole as closely as possible, and it must usually be custom designed and made. Other means of rehabilitating include the use of a sleeve or cylinder disposed within the manhole which forms an annulus between itself and the existing brick structure. The annulus is filled with grout to form a lining. However, since the confines of the manhole are extremely irregular, the temporary liner is difficult to properly configure, and the operation is haphazard and unreliable at best.

Mortar, generally a mixture of lime, cement or both with sand and water is used as a bonding agent between brick, tile or concrete blocks. Grout is a form of mortar used to fill narrow cavities such as joints, rock fissures, gaps between adjacent bricks, tile, concrete blocks or rocks. Shotcrete is often referred to as mortar or concrete conveyed through a hose and pneumatically projected at a high velocity onto a surface. This is also referred to as "gunned" concrete or gunnite. Information on shotcrete is seen in *ACI Standard Recommended Practice for Shotcreting* (ACI 506-66) published 1966 by the American Concrete Institute. In the wet mix process "shotcreting" all of the ingredients including the mixing water are first thoroughly blended and the mortar or concrete mixture is introduced into the chamber of the delivery equipment. Compressed air is employed to thrust the mixture through a hose and delivery apparatus and the mixture is jettisoned from the nozzle at high velocity onto a surface to be "shotcreted."

A variety of prior art mortars have been developed for shotcreting. Shotcreting is advantageous because it is often more economical than conventional concrete. It requires only a small portable plant for manufacture and placement. It can produce an excellent bond with a number of materials and it is ideal for roofing, certain coatings over brick and masonry, the encasement of structural steel for fireproofing, and the repair of deteriorated concrete structures. However, while the durability of shotcrete structures has been generally good, shotcrete repair work is subject to severe frost action and aggressive water action. In other words, known shotcrete coatings are easily degraded by exposure to water, particularly pressurized water. As a result, it is known to apply hot linseed oil to shotcrete to enhance its water resistance characteristics.

The shotcrete may include either Portland cement or calcium aluminate cement which is a rapid hardening cement. Sand, properly graded, is employed for aggregate. Other light weight aggregates may be used. Various admixtures such as accelerators like calcium chloride, air-entraining admixtures, retarders, and mineral admixtures are known. It is known to employ fly ash for increasing plasticity, reducing sagging and improving resistance to sewer gases such as sulfates. Asbestos fibers, clay and other materials have also been known to serve these purposes. Typically known mineral admixtures result in shrinkage and a decrease in strength and durability of the finished product. Also, shotcrete is typically very sensitive to the surface characteristics of the target. For example, it has generally been found unsatisfactory for the wet and moist conditions encountered in sewers. Rebound and nozzle forces caused by the necessary high volume of compressed air and sand make the process difficult and unworkable. Further, a recommended minimum thickness of two inches of material applied over a welded wire reinforcing mesh is typical. This system is labor intensive, time consuming, and expensive. Crew experience is critical in shotcreting applications. Thus shotcreting is not a viable method for manhole rehabilitation.

An American Concrete Institute (ACI) publication entitled *Concrete Sanitary Engineering Structures*, ACI-350R-77, published 1977, discusses a variety of considerations and special requirements for using concrete mixtures on sanitary engineering structures. The publication discusses the use of certain materials upon reservoirs and manholes and recognizes that wide cracks and other structural damage accumulating over the years promotes leakage. In order to promote "water tightness" the concrete must be impervious to liquids, crack width must be minimized, and the joints must be properly sealed. It is recognized in the art to provide minimum permeability by using water-cement ratios as low as possible consistent with workability, and that subsequent surface treatment by troweling or the use of smooth forms give good results.

The prior art reflects numerous patents which teach the relining or repair of sewer conduits with add-on, sleeve-like liners. U.S. Pat. No. 4,796,669 Issued to St. Onge, Jan. 10, 1989 discloses a method for relining buried pipeline by coaxially inserting interconnected plastic sections of tubing within the pipeline. These sections are glued together until the entire pipeline has been relined. U.S. Pat. No. 4,245,970 issued, issued Jan. 20, 1981 also discloses the relining of a sewer pipe with plastic pipe liner. Britain patent No. 4,818,314 issued Apr. 4, 1989 discloses a similar system including a plurality of liner segments for relining pipelines. U.S. Pat. No. 4,846,147 issued July 11, 1989 discloses a chimney liner system wherein a sleeve formed from a fiberglass cloth is inserted interiorly to reline the chimney.

U.S. Pat. No. 4,456,401 issued June 26, 1984 employs a felt liner impregnated with a liquid resin material inserted within the sewer line for repair. U.S. Pat. No. 4,386,628 Issued June 7, 1983 teaches the maintenance lining passageways by inserting into it a flexible tubular material of a lower diameter. The tubular material is a laminate having an outer contiguous layer of a composition foamable to form an expanded cellular structure. The pipe is expanded and solidifies in place within the pipe.

Another popular method is to provide a segmented series of pipes or liner sections inserted into the pipe to be repaired. An annulus results between the pipe and the "liner", and grout or cementitious material may be pumped into the annulus to form an interior lining. U.S. Pat. No. 4,751,799 issued June 21, 1988 employs liners comprising a plurality of individual liner sections to define the inner surface of the manhole member to be "relined". The resultant annulus thereafter receives grout. U.S. Pat. Nos. 4,728,223, issued Mar. 1, 1988; 4,602,659 Issued to Parkyn July 29, 1986, Parkyn 4,601,312 issued July 22, 1986, and 4,350,548 issued Sept. 21, 1982 all depict systems in which a resultant annulus is filled with grout.

U.S. Pat. No. 4,325,772 issued Apr. 20, 1982, shows the use of flexible liner tube within an installed pipe, and a liquid adhesive agent is forced into the annulus formed there between. Allen Pat. No. 4,678,370 issued July 7, 1987 discloses a system of helically wound internal liners which define an annulus within the sewer pipe for receiving cementitious grout. A related invention is seen in Telford patent No. 3,269,421 issued Aug. 30, 1966. U.S. Pat. No. 3,834,433 issued to Larson on Sept. 10, 1974 discloses a sewer repair apparatus adapted to be moved within a pipe and centered upon a leaking area. Ends of the apparatus thereafter expand to form a seal, centered over the leaking pipe area. Subsequent pressurization of this area forces grout outwardly through the annulus, through the ends of the pipe, and forms an internal and external coverage for patching the leak.

A number of patents also relate to the mechanical concept of providing a mechanically moving carriage which travels through the pipe and services it on the way. These devices are limited to pipes running horizontally or near a horizontal plane and of a constant diameter. Lona U.S. Pat. No. 4,777,905, issued Oct. 18, 1988 is typical. A carriage is guided coaxially through a pipeline to be repaired, and it applies a coating through a plurality of radially operated rollers which contact the underside of the pipe wall. Similarly, Cook U.S. Pat. No. 2,894,539 issued July 14, 1959 discloses apparatus for traveling through the interior of the pipeline which concurrently applies sealant. U.S. Pat. Nos. 4,181,484, issued Jan. 1, 1980 and U.S. Pat. No. 4,781,556 show similar techniques.

Crom U.S. Pat. No. 2,484,018 issued Oct. 11, 1949 discloses a carriage mounted system which moves axially through a horizontal grout radially through a spraying process. Nakashin U.S Pat. No. 4,370,113 also discloses a carriage movable axially within a pipe which applies grout radially within the pipe. Also relevant is U.S. Pat. No. 3,728,223 which constructs an internal reliner through apparatus moving through the center of the pipeline.

U.S. Pat. No. 4,769,077 issued Sept. 6, 1988 discloses a cementitious grout formulation characterized by fast setting for use and repairing concrete surfaces. Another suitable concrete is seen in U.S. Pat. Nos. 4,772,327 issued Sept. 20, 1988. U.S. Pat. No. 3,871,583 issued Mar. 18, 1975 discloses a cement spray gun with remote air injection suitable for use with spray crete. U.S. Pat. No. 4,796,814 issued Jan. 10, 1989 discloses a cement nozzle suitable for use in applying spray crete. Another spray gun is seen in U.S. Pat. No. 3,708,124, issued Jan. 2, 1973.

No known systems reveal a spray-applied, monolithic concrete liner/reliner for manholes.

SUMMARY OF THE INVENTION

A method for spray-applicating a custom, homogeneous, monolithic cementitious liner for rehabilitating deteriorated manholes is proposed. Further, a manhole constructed in accordance with the process is disclosed.

The manhole to be serviced and repaired is first cleaned. The typically brick, tile, concrete block, or concrete interior surfaces are cleaned with a water pressure solution. Loose fragments of the infrastructure are forcibly removed. A cementitious mixture prepared in a suitable pneumatic spray applicating system is spray-applied to the interior surfaces or the manhole to create a continuous, monolithic interior liner. This lining is formed in place and configured substantially identically to the internal shape and geometry of the manhole. When the liner "sets," usually within one to twenty-four hours after installation, a substantially impervious water and chemical resistant barrier prevents manhole ingress by ground water.

The preferred cementitious mixture is a lightweight, high silicate, fiber-reinforced blend containing special chemical additives. The cementitious mixture when mixed with 20% to 40% water by weight and spray applied as directed in this invention will produce a unique monolithic liner which conforms in custom fashion to widely varying manhole shapes. Specific structural strength characteristics, enhanced water impermeability, and improved chemically resistant properties are exhibited by the monolithic cementitious liner/reliner and the improved manhole herein disclosed.

Thus a fundamental object of the present invention is to provide a system of the character described for lining/relining and rehabilitating manholes.

A similar basic object of the present invention is to provide a spraying system for rehabilitating manholes, which enables a monolithic, jointless liner to be installed in place without custom designing any individual segments.

A fundamental object of the present invention is to provide a manhole rehabilitation system of the character described which will greatly enhance the water resistance characteristics of the resultant repaired manhole over anything known to the prior art and will give structural strength equal to or greater than the original structure.

A still further object is to provide a system capable or bonding manhole access rings to the associated manhole chimney section.

Another object of the present invention is to provide a manhole rehabilitating seal which concurrently remedies cracking problems either longitudinal or circumferentially, of the type caused by on-going settlement or shifting of the pipeline or road bed.

Another fundamental object is to provide a spray on rehabilitating and lining/relining structure of the character described, which can be deployed in-situ, and which is capable of extensive rehabilitation and is not limited to mere touch-up work.

Another object of the present invention is to provide a monolithic rehabilitation liner/reliner for manholes of the character described which will readily pass conventional vacuum tests, water and smoke tests applied to manholes to insure its integrity.

Another basic object is to provide a system of the character described which can readily be employed with manholes of varying diameters and lengths.

A still further object of the present invention is to provide a spray lining/relining system of the character described made up primarily of a fiber reinforced, high tensile strength impermeable concrete.

A still further object is to provide a system for lining/relining manholes which does not require the use of a precast or predesigned liner, and which avoids the use of mesh screen, form liners and poured annulus relining systems.

Another object is to provide a new manhole which has been lined in accordance with the process disclosed.

A related object is to provide a cementitious mixture ideally adapted for manhole lining/relining and/or rehabilitation.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
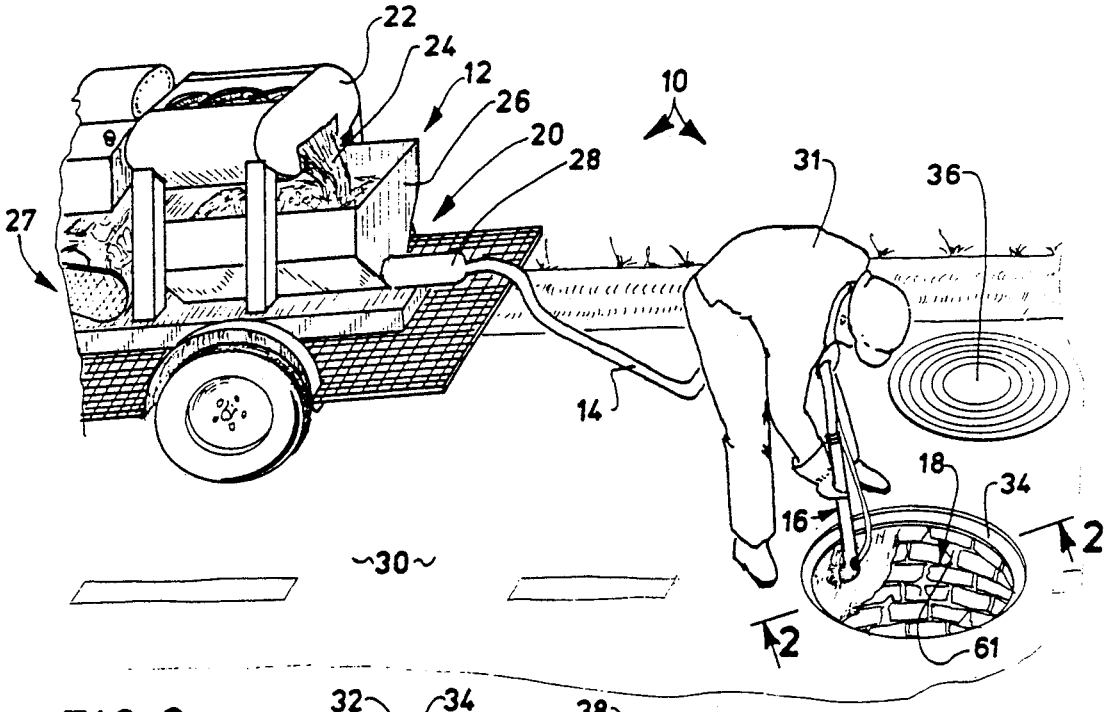
FIG. 1 is a fragmentary, pictorial view illustrating a preferred mode of practicing the instant invention.
Figure 2:
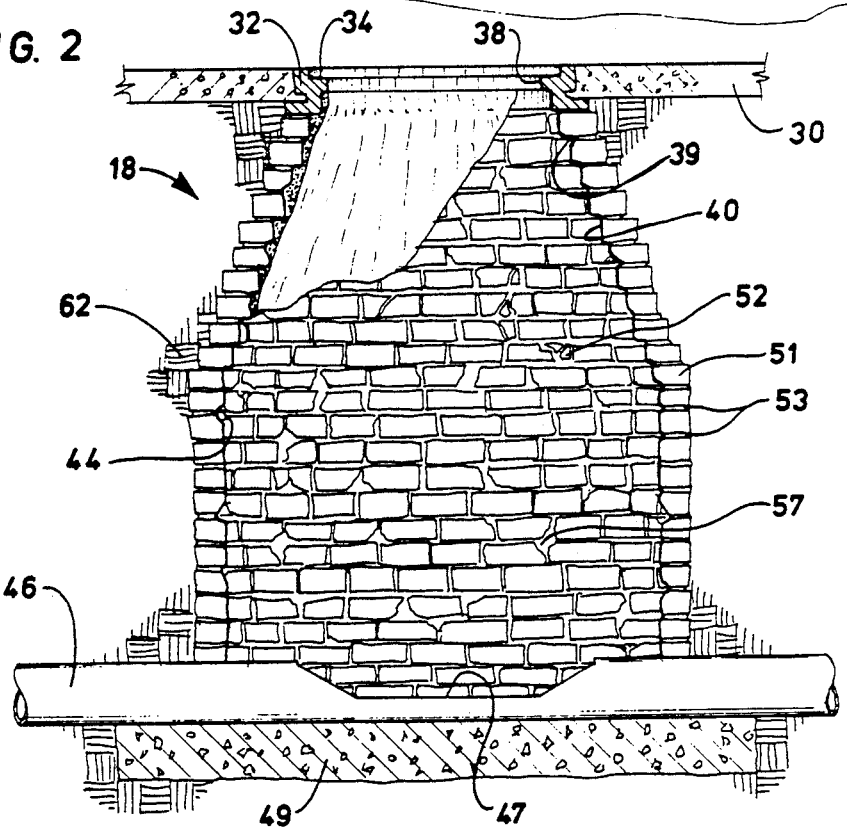
FIG. 2 is an enlarged, fragmentary vertical cross sectional view taken generally along line 2—2 of FIG. 1 showing a typical subterranean manhole, and a portion of a sewer line which forms a junction therein.
Figure 3:
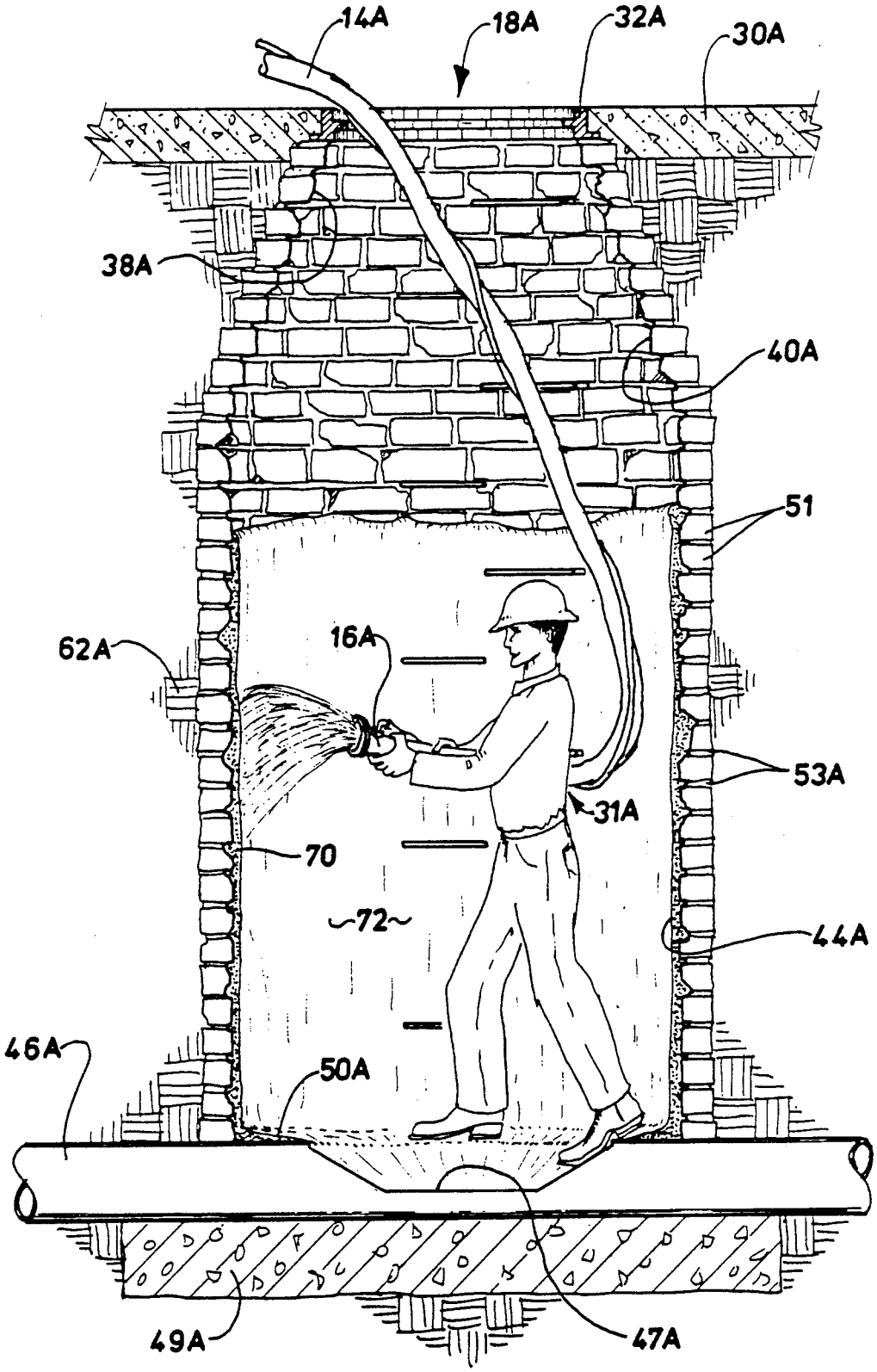
FIG. 3 is an enlarged, sectional view similar to FIG. 2 but showing an alternative, larger manhole.
Figure 4:
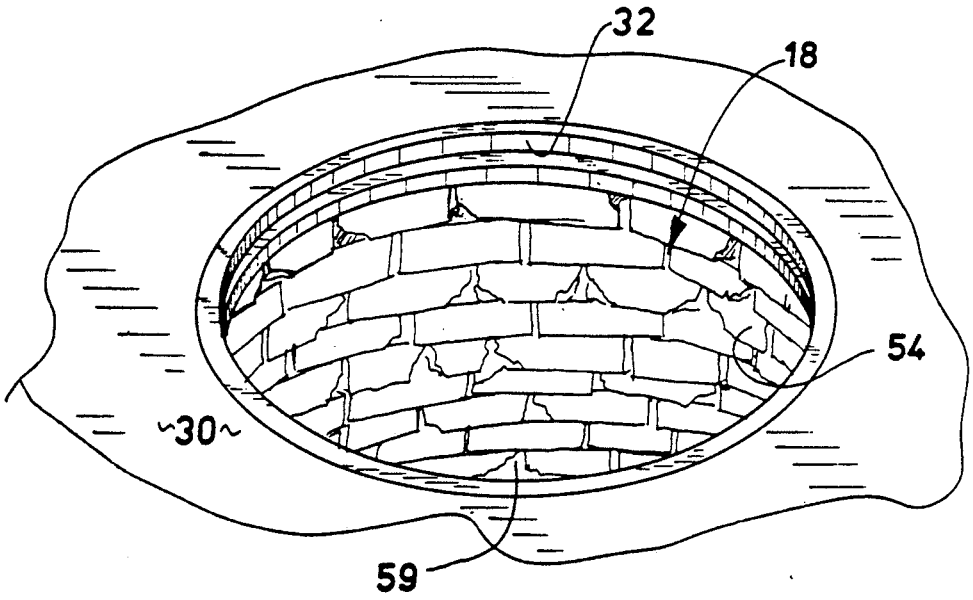
FIG. 4 is a fragmentary, perspective view of another manhole which needs rehabilitation in accordance with the invention; and, FIG. 5 is a fragmentary, perspective view showing a properly rehabilitated manhole in accordance with the lining and/or relining process of the invention.
Figure 5:
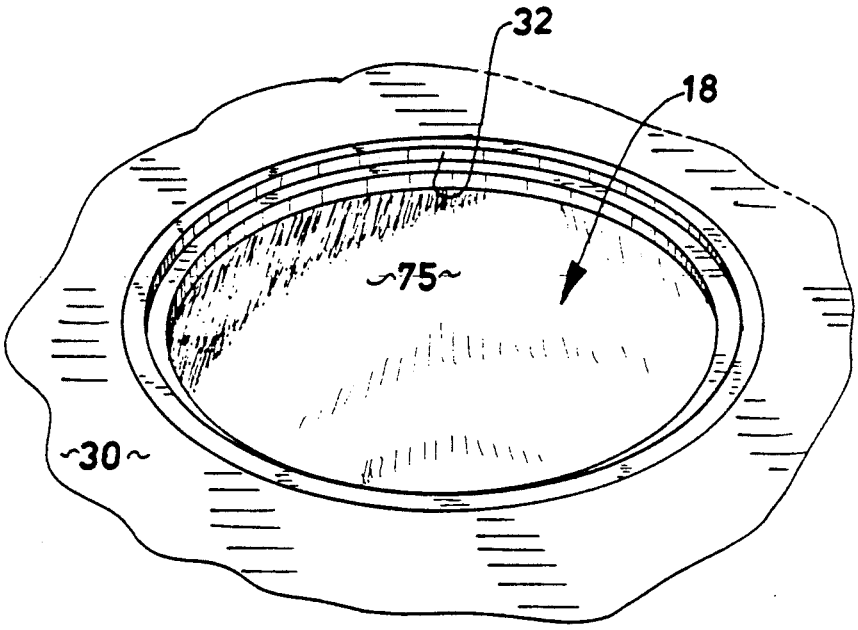

With attention now directed to the appended drawings, the overall system is best illustrated in FIG. 1. FIGS. 2 and 3 contrast different manhole designs which are often encountered in use. For purposes of convenience, corresponding parts of the manhole 18 shown in FIG. 2 have been designated where possible in FIG. 3 with the same reference numeral, but with the suffix A. FIGS. 4 and 5 respectively depict a manhole structure both before and after successful lining or relining treatment by my system. As a preliminary matter it is to be understood that the terms "line" and "reline," within the sewer industry, are often employed interchangeably.

The deteriorated manhole of FIG. 4 may be said to be "lined" since the vertical hole in the ground has been, in one sense, "lined" with bricks and mortar comprising the structure. If the latter connotations of the word "line" are embraced, then the manhole of FIG. 5 can be said to have been "relined" by the covering applied over its brick and mortar interior. Others would refer to the manhole of FIG. 5 as having been "lined" by the coating to be described, and such folks would refer to the manhole of FIG. 4 as "unlined." As used herein the terms may be employed together (i.e. "lined/relined") to refer to a rehabilitated manhole such as that of FIG. 5.

With reference to FIG. 1, my system for rehabilitating manholes has been generally designated by the reference numeral 10. System 10 contemplates a mixing station generally designated by the reference numeral 12, which interconnects via a conventional hose 14 to a pneumatic sprayer 16. The manhole to be rehabilitated has been generally designated by the reference numeral 18. The mixing station may comprise a variety of designs that may generate the necessary gentle mixing action required or fragile aggregate mixtures. Pumping station 12 may comprise a variety of different types of trucks 20 having a suitable mixing apparatus 22 feeding the proper cementitious mixture to a storage bin 26.

Mixture 24 may be dumped into the mixing bin 22 in dry for directly out of the bag. It is mixed to a preferred ratio of thirty percent by weight of water, and conveyed to bin 26. Pump station 12 may be powered by the conventional motor apparatus 27 and the pump output 28 is interconnected with hose 14. The workman 31 may manipulate the sprayer 16 in a variety of configurations. Workman 31A is shown within an alternative manhole 18A (FIG. 3).

With reference now to FIG. 2, the road bed has been designated by the reference numeral 30. (In FIG. 3, the road bed is 30A). It surrounds and mounts a manhole ring 32 which includes an upper recessed shoulder 34 (FIG. 1) upon which a typical circular iron manhole cover 36 is snugly disposed. Its reduced diameter lip 38 (FIG. 2) prevents the manhole cover 36 from dropping into the manhole interior, and provides a seal against which the outer peripheral ring of the manhole is tightly pressed when properly inserted.

A typical manhole includes an upper, chimney portion generally designated by the reference numeral 39, which is interconnected with the manhole ring 32. The cone section of the manhole, sometimes referred to as the corbel, has been generally designated by the reference numeral 40. As will also be appreciated the uniform diameter lower region, generally designated by the reference numeral 44, provides access to workman 31 to the conventional sewer invert 46. The sewer inverts 46 and 46A extend horizontally at the bottom of the manhole structures. Interconnected subterranean pipe (not shown) extends generally horizontally between spaced apart manholes and various downline sewer pumping and junction stations. The invert region 47 is "open" and inspection of the sewer system may be made by direct observation. Workman 31A (FIG. 3) typically may stand upon a bench section 50A of the sewer, which is disposed at the bottom of the manhole on either side of the invert 47 or 47A. The open air section of invert 47 is generally supported over a lower concrete base 49 or 49A.

With primary reference now directed to FIGS. 2 through 4, the interior portions of the manhole are typically constructed from mortar, brick, tile, concrete block or concrete. Of course certain precast manholes exist as well. Typically as time goes on certain bricks such as bricks 52 (FIG. 2) and 54 (FIG. 4) may break away and deteriorate. Irregular regions of different dimensions such as regions 57 (FIG. 2) and 59 (FIG. 4) exist, contributing to the overall decay and deterioration of the sewer system. When the manhole has deteriorated, water within the surrounding ground regions 62 or 62A can penetrate the circumferential walls of the manhole, resulting in seepage (infiltration). This is particularly true in response to high rains or flash floods, since the water resistance of known manholes, even after being treated with conventional systems, is extremely weak.

When manhole infiltration occurs, water quickly rushes into the invert 47 or 47A, and flows through the pipeline to the next station. As will be appreciated by those skilled in the art, when overfilling occurs in this manner, untreated sewage can be haphazardly broadcast throughout relatively large surface areas. And, since all of the sewer lines eventually lead to the treatment plant, treatment capacity can be readily exceeded. As a result, untreated effluent may be discharged to streams, lakes, rivers, or oceans.

The basic brick, tile or concrete block construction 52 includes a plurality of conventional radially spaced apart bricks, tile or concrete block formed in layers, and separated by intermediate layers of mortar 53. The mortar thickness is ideally approximately 0.375 inches thickness. By applying cementitious mixture 24 according to the teachings of the present invention, the applicator generates a contiguous, custom, conformed liner which in effect seals the interior of the manhole against outside pressure. This application results in a liner or a thickness approximately the thickness of the mortar 53 between adjacent bricks.

Workmen 31 and/or 31A may begin by washing the visible manhole interior surface with high pressure spray water, so that it is properly cleaned prior to application. Loose brick, tile, concrete block or mortar, such as bricks 52, are chipped out and removed. When the surface has been properly treated, the cementitious mixture 24 is pneumatically sprayed through hoses 14 or 14A, and the user will apply a uniform, even coating until the thickness is appropriate.

As best seen in FIG. 3, for example the edge 70 of the monolithic liner/reliner 72 will be approximately equal in width to the mortar width layers 53A. Spraying may radially continue from the bottom of the manhole upwardly through the cone and if the operator wishes, he may apply the final touches from above ground, as in FIG. 1.

After application, the outer, cylindrical liner surface is smoothed by manual troweling so that the interior 75 (FIG. 5) presents a smooth and continuous inner facade. It will be noted that all of the bricks, tile, concrete block and the mortar joints between the bricks forming the manhole have now been filled and covered. After hydration, the lining sets in place to conform exactly to the internal geometry of the manhole. The uniform and integral lining which hardens in place is highly water resistant. Since it has no seams, cold joints or discontinuities, leakage is significantly resisted.

The preferred lightweight concrete mixture has a dry bulk density of between 54 lbs. to 57 lbs. per cubic feet with all additives included other than water. The cementitious mixture comprises a pair of chemically active ingredients which react with calcium hydroxide resulting from portland cement hydration to form hydrated calcium silicates which will not leach back from the final product. A de-air entraining agent for removing air from the mixture is necessary to minimize resultant liner porosity. The mixture is fiber reinforced with alkaline resistant glass rods.

When properly mixed for subsequent spray application, the mixture will result in a minimum 3,000 lb. per sq. in. (PSI) compressive strength in approximately twenty four to twenty eight days. Ultimate compressive strengths of 5000 PSI have been observed. This mixture is formulated for the purpose of producing a monolithic concrete liner contoured to the shape of the manhole that is impermeable to the flow of water when properly applied at the minimum thickness of 0.375 inches.

Table 1 compares a conventional un-lined brick manhole with a typical "rehabilitated" manhole lined in accordance with the invention:

TABLE 1

NEW BRICK MANHOLE vs. REHAB BRICK MANHOLE

| New Brick: | Rehabilitated: |
|---|---|
| Material: masonry, cement mortar, brick block. | Material: Monolithic liner of portland cement based, cementitious mix applied over existing brick or block. |
| Strength: dependent upon bond strength of mortar to brick or block which varies according to brick construction, absorption and mortar strength and application. | Strength: dependent upon cementitious liner strength as a reinforcement to existing unit prior to rehab. |
| Porosity varies according to workmanship and air content of mortar. | Porosity: reduced by cementitious mixture which produces non-porous matrix which is further consolidated by troweling. |
| Flexural strength - depends upon masonry cement, mortar and brick interface. | Flexural strength: monolithic liner enhanced by fiber reinforcement (in excess of 2.5 times). |
| Permeability Resistance to penetration by aggressive agents minimized by the many interfaces, cracks, and porosity of mortar. | Permeability Resistance to penetration enhanced by jointless, monolithically applied liner and impermeable surface resulting from troweling. |
| Application Bench, brick and mortar construction conducive to leakage resulting in voids | Application Monolithically applied to result in no joint walls to bench and continuous |

TABLE 1-continued

| NEW BRICK MANHOLE vs. REHAB BRICK MANHOLE | |
|---|---|
| New Brick: | Rehabilitated: |
| and subsequent infiltration. | surface throughout bench preventing inflow and exflow. |

TABLE 2

| Characteristics of Preferred Cementitious Mixture: | | | |
|---|---|---|---|
| ASTM C109 | Compressive Strength, psi | 28 days | 4000 psi* |
| ASTM C190 | Tensile Strength, psi | 28 days | 400 psi |
| ASTM C348 | Flexural Strength, psi | 28 days | 1800 psi |
| ASTM C67 | Absorption, percent | <1% | |
| ASTM C596 | Shrinkage, percent | <0.05% | |
| ASTM c666(A) | Freeze Thaw | no visible defects after 30 cycles | |
| ASTM E-96 | Water Vapor Transmission | (gms/24 hr./$m^2$) 2 gms. | |

(*compared to 750 psi for mortared brick only and mortared brick with coating)

The preferred cementitious mixture comprises twenty to forty percent water by weight. Preferably the cementitious mixture comprises approximately one to ten percent of a silicate aggregate by weight, preferably four to six percent perlite. It is preferably sixty to seventy percent Portland cement by weight, twenty to thirty percent by weight pozzolonic material such a fly ash, and one-half to five percent by weight fiberglass rods for reinforcement. Two important ingredients are the silica in the perlite and the free lime in the cement, which react with the calcium hydroxide in the cement to form hydrated calcium silicates.

Preferred chemical additives are silicone and polyvinyl alcohol, each of which comprises less than one percent of the mixture by weight. The silicone eliminates air entrainment to make the liner water impermeable. The polyvinyl alcohol acts as a cohesion or bonding agent facilitating liner bonding to the treated manhole substrate.

EXAMPLE 1

A ten foot deep brick manhole in Pine Bluff Arkansas was treated according to the invention. An estimated sixty percent of its original mortar was missing between adjacent bricks, which factor contributed significantly to environmentally impermissible infiltration and exfiltration rates. As a practical matter the structural integrity of the manhole no longer existed. An attempt was made to conduct an industry standard vacuum test on this particular manhole prior to rehabilitation, but manhole integrity was so badly compromised that a vacuum test was impossible. Missing brick around the manhole ring was allowing significant inflow from the street during rain runoff.

This manhole was cleared and prepped, with all debris washed from the walls, the lower bench, and the invert with a 1200 PSI high pressure water sprayer. All loose mortar and brick fragments were removed. Five hundred pounds of the above described cementitious mixture were used to line/reline the manhole. Three hundred pounds were applied to the surface on the first coat, filling both the void under the manhole ring and the surface or the brick. This coat was then rough troweled to assure a good mechanical bond.

Approximately one hour later, a second coat was applied to assure total coverage of the manhole wall and bench, and to assure that a minimum liner thickness of 0.375 inches resulted. This coat was then troweled to a smooth finish. A repair to the invert was necessary, because of breaks in the invert pipe. A fast coating with an accelerated set time was applied to the invert. After fifteen minutes, the plugs were removed and normal sewerage flow was reestablished. It took slightly more than one hour to rehabilitate this manhole.

Two days later the manhole was reinspected. There were no signs of any infiltration, exfiltration or inflow present, even though it rained heavily the night before. The final product was quality tested according to preexisting vacuum test standards for sewers. The lower sewer inflow and outflow lines were plugged. The industry standard vacuum test pulls an eleven inch vacuum on the "sealed" and isolated manhole, and to pass the test, the vacuum cannot drop more than one inch in one minute. The rehabilitated manhole "passed."

EXAMPLE 2

Manhole #33 at Wilton, Arkansas exhibited significant infiltration and exfiltration problems. Weaknesses existed around the juncture of the transfer pipe, the precast manhole walls at the lift holes which were never sealed, and at the joints of the manhole walls. These problems contributed to excess flow to the sewer treatment plant when rains occurred.

This eight foot deep pre-cast manhole was cleaned and prepped. Approximately ½ cubic yard of Strong-Seal brand grout was pumped behind the walls of the manhole. Afterwards, 400 pounds of the above disclosed mixture were applied in the same manner as described in Example 1. The resultant liner sealed and rehabilitated the manhole. The same vacuum test was applied, as outlined in Example 1, and the manhole passed. This repair took approximately two hours.

EXAMPLE 3

A four foot deep brick manhole in Oaklawn, Kans. was cleaned, prepped and lined/relined as outlined in Example 1. Both mortar and brick were missing. Two hundred pounds of the mixture were required to completely rehabilitate the structure. All vacuum tests were passed.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A method of lining/relining manholes to rehabilitate, reinforce and seal them, said method comprising the steps of:

(a) locating a manhole to be lined/relined;

(b) preparing the interior and interior surfaces of the manhole by cleaning the brick, tile, concrete block and mortar or concrete interior thereof and removing loose particles of brick, mortar or the like;

(c) spraying a monolithic cementitious mixture containing a hydraulic cement about the interior surfaces of the manhole to create a continuous monolithic interior liner formed in place and custom configured at the job site substantially to the internal geometry of the manhole; and, (d) allowing said liner to set, whereby the flexural strength of said manhole is enhanced.

2. For manholes having at least a partial brick, tile, concrete block or concrete interior housing of a non-uniform dimension extending vertically between an upper manhole cover and a buried generally horizontally extending sewer pipe or conduit, a method of lining/relining the manholes to rehabilitate and reinforce them, said method comprising the steps of:

(a) locating a manhole to be lined/relined;

(b) preparing the interior and interior surfaces of the manhole by cleaning the brick, tile concrete block and mortar or concrete interior thereof and removing loose particles of brick, mortar or the like;

(c) preparing a monolithic, lightweight, high silicate, fiber-reinforced cementitious hydraulic cement mixture suitable for subsequent spray application;

(d) spraying said cementitious mixture about the interior surfaces of the manhole to create a continuous monolithic impervious interior liner formed in place at the job site and configured substantially to the internal geometry of the manhole; and, (e) allowing said liner to set, whereby the flexural strength of said manhole is enhanced.

3. A restored and structurally reinforced manhole comprising:

(a) a circumferential shroud formed of brick, tile, concrete block and mortar or other building units, said shroud comprising an interior and adapted to be buried in the ground;

(b) said interior of said shroud facilitating human access to a buried sewer conduit;

(c) a sprayed cementitious liner within said manhole upon said interior creating a continuous monolithic interior liner formed in place and custom configured at the job site substantially to the internal geometry of the manhole; and, whereby the flexural strength of said manhole is enhanced by said liner.

4. The manhole of claim 3 wherein said liner possesses:

(a) minimum wickability of water;

(b) minimum capillary action of water; and (c) a flexural strength in excess of sixty percent of the flexural strength of a conventional masonry brick/-block or coated brick/block manhole; and, (e) a sulfate resistance in excess of customary mortar, brick/block or coated brick/block or porous portland cement concrete construction.

* * * * *

UNITED STATES PATENT AND TRADEMARK OFFICE

CERTIFICATE OF CORRECTION

PATENT NO. : B1 5,002,438

DATED : May 30, 1995

INVENTOR(S) : William A. Strong

It is certified that error appears in the above-indentified patent and that said Letters Patent is hereby corrected as shown below:

Column 2, line 21, delete "4,722,327" and insert --4,772,327--.

Column 3, line 44, delete "hydrate" and insert --hydrated--.

Column 3, line 52, delete "lines 21-32" and insert --lines 55-64--.

Column 4, line 61, delete "comprises" and insert --comprising--.

Column 5, line 2, delete "claim 13" and insert --claim 17--.

Column 6, line 56, delete "claim 9" and insert --claim 5--.

Column 6, line 60, delete "claim 43" and insert --claim 42--.

Column 7, line 7, delete "5%" and insert --6%--.

Signed and Sealed this

Third Day of October, 1995

Bruce Lehman

*Attest:*

BRUCE LEHMAN

*Attesting Officer*

*Commissioner of Patents and Trademarks*

US005002438A

REEXAMINATION CERTIFICATE (2591st)

United States Patent [19]

Strong

[11] B1 5,002,438

[45] Certificate Issued May 30, 1995

[54] METHOD OF REHABILITATING MANHOLES BY CUSTOM LINING/RELINING

[75] Inventor: William A. Strong, Pine Bluff, Ark.

[73] Assignee: Strong Systems Inc., Pine Bluff, Ark.

Reexamination Request:
No. 90/003,263, Nov. 23, 1993

Reexamination Certificate for:

| | |
|---|---|
| Patent No.: | **5,002,438** |
| Issued: | **Mar. 26, 1991** |
| Appl. No.: | **460,652** |
| Filed: | **Jan. 3, 1990** |

[51] Int. Cl.[6] ..... E02D 29/12

[52] U.S. Cl. ..... 405/303; 405/133; 405/268

[58] Field of Search ..... 405/137, 150.1, 154, 405/266, 267, 268, 303; 52/20, 744; 138/97; 264/31, 32, 36

[56] References Cited

U.S. PATENT DOCUMENTS

| | | | |
|---|---|---|---|
| 443,992 | 1/1891 | Hart . | |
| 1,876,205 | 9/1932 | Crom . | |
| 2,187,224 | 1/1940 | Cory | 72/130 |
| 3,676,198 | 7/1972 | McGroarty | 117/105.5 |
| 3,745,738 | 7/1973 | Singer | 52/741 |
| 3,990,249 | 11/1976 | Senn | 61/10 |
| 4,695,188 | 9/1987 | Pulkkinen | 405/150 |

FOREIGN PATENT DOCUMENTS

| | | |
|---|---|---|
| 2574836 | 6/1986 | France . |
| 8900633 | 1/1989 | Germany . |

OTHER PUBLICATIONS

American Concrete Institute, State-of-the-Art Report on Fiber Reinforced Shotcrete, 1984, pp. 506.1R-1-506.1R-2.

American Concrete Institute, Guide to Shotcrete, 1985, pp. 506R-1-506R-41.

Stewart, "New Test Data Aid Quality Control of Gunite", *Engineering News-Record*, Nov. 9, 1933.

Glassgold, "Shotcrete Durability: An Evaluation", *Concrete International*, pp. 78-85, Aug. 1989.

General Gunite and Construction Co., Manhole Rehabilitation.

Thompson, R. and Herning, J., Manhole Rehabilitation Cuts "I&T", Public Works, Jun. '85, pp. 105, 150.

Magill, F. D., Jr., P. E., Chemical Grout Rehabilitation of Manholes, Public Works, Oct. '84, pp. 50-52.

*Primary Examiner*—David H. Corbin

[57] ABSTRACT

A method for lining or relining a sewer manhole, apparatus comprising an improved leak resistant manhole, and a cementitious mixture for lining/relining manholes. A homogeneous, monolithic, cementitious liner is spray applied in place within a concrete or brick-and-mortar manhole infrastructure without forms, webbing, or re-bar. A manhole to be serviced is first located and spray cleaned with water. Loose concrete and mortar fragments of the original structure are forcibly removed. A cementitious mixture is spray-applied to the interior surfaces of the manhole to create a continuous, monolithic interior liner. This lining is configured substantially identically to the internal shape and geometry of the manhole. When the liner sets after installation, a substantially impervious water and chemical resistant barrier prevents manhole ingress/egress by ground water. The preferred cementitious mixture is a lightweight, high silicate, fiber-reinforced blend, which, when mixed with 20% to 40% water by weight and properly spray applied, will produce a monolithic liner having hitherto undiscovered geometric and structural strength characteristics, including improved water impermeability and chemically resistant properties. The disclosed structure and process contribute positively to the promotion of improved sewer system integrity.

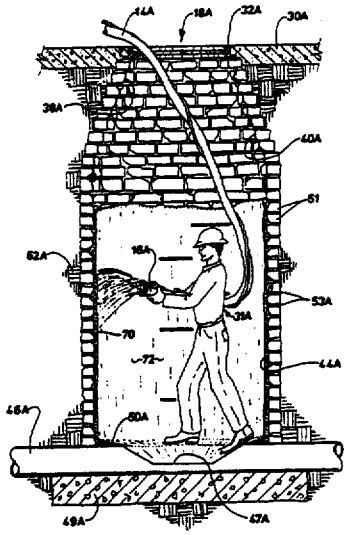

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 1, lines 21–35:

Complex sewer utilities [comprises] *comprise* a variety of interconnected lines, pumping stations, conduits and the like. Municipal sewers typically comprise a plurality of networked, generally horizontally extending underground lines which are generally, but not always, built adjacent to and beneath the street network. These sewers include horizontal, subterranean lines formed of longitudinally aligned sections of slightly inclined pipes, which terminate periodically within manholes. A manhole is essentially a vertical passageway, typically beginning at ground level or at the street surface, which extends into the ground and receives one or more sewer line junctions. Manholes enable human access to line junctions and installations, for system inspections, maintenance and repairs.

Column 3, lines 21–43:

As recited in the aforementioned publication, Utility Infrastructure Rehabilitation, pages 5-57 through 5-58, there [exists] *exist* three common methods which are used for rehabilitating manhole structures. It is known to apply coating to the interior wall of the manhole, and coatings can be made of epoxy, acrylics, polyurethanes etc. They may be applied directly over brick, tile, concrete block or concrete and to a certain extent they are waterproof and corrosion resistant. Typically an epoxy coating is applied by troweling. Acrylic coatings are applied with a brush and polyurethane coatings have been applied with an airless sprayer. For repairs, the surface of the manhole must be clean and free of debris. Generally a structurally sound manhole is required, and rinsing and cleaning [through] *using* detergents and various forms of cleaning solutions may be necessary. Proper surface cleaning is critical, and the surface must be allowed to properly dry for certain types of coatings such as polyurethane. In general all leaks must be plugged using patching or grouting materials. Usually quick drying grouts are used and they are troweled into place. It is known to employ cement patches, polyurethane foam and a variety of chemical grouting materials to stop leaks.

Column 5, lines 24–33:

U.S. Pat. No. 4,456,401 issued June 26, 1984 employs a felt liner impregnated with a liquid resin material inserted within the sewer line for repair. U.S. Pat. No. 4,386,628 [Issued] *issued* June 7, 1983 teaches the maintenance lining *of* passageways by inserting [into it] a flexible tubular material of a lower diameter *into the passageway*. The tubular material is a laminate having an outer contiguous layer of a composition foamable to form an expanded cellular structure. The pipe is expanded and solidifies in place within the pipe.

Column 6, lines 12–20:

Crom, U.S. Pat. No. 2,484,018 issued Oct. 11, 1949 discloses a carriage mounted system which moves axially through a horizontal [grout radially grouting] *pipe and radially disperses grout* through a spraying process. Nakashin, U.S. Pat. No. 4,370,113 also discloses a carriage movable axially within a pipe which applies grout radially within the pipe. Also relevant is U.S. Pat. No. 3,728,223 which constructs an internal reliner through *an* apparatus moving through the center of the pipeline.

Column 6, lines 21–31:

U.S. Pat. No. 4,769,077 issued Sep. 6, 1988 discloses a cementitious grout formulation characterized by fast setting for [use and] repairing concrete surfaces. Another suitable concrete is seen in U.S. Pat. [Nos] *No.* 4,722,327 issued Sep. 20, 1988. U.S. Pat. No. 3,871,583 issued Mar. 18, 1975 discloses a cement spray gun with remote air injection suitable for use with spray crete. U.S. Pat. No. 4,796,814 issued Jan. 10, 1989 discloses a cement nozzle suitable for use in applying spray crete. Another spray gun is seen in 3,708,124, issued Jan. 2, 1973.

Column 8, lines 35–47:

With reference to FIG. 1, my system for rehabilitating manholes has been generally designated by the reference numeral 10. System 10 contemplates a mixing station generally designated by the reference numeral 12, which interconnects via a conventional hose 14 to a [pneumatic] sprayer 16. The manhole to be rehabilitated has been generally designated by the reference numeral 18. The mixing station may comprise a variety of designs that may generate the necessary gentle mixing action required [or] *for* fragile aggregate mixtures. Pumping station 12 may comprise a variety of different types of trucks 20 having a suitable mixing apparatus 22 feeding the proper cementitious mixture to a storage bin 26.

Column 8, lines 48–56:

Mixture 24 may be [dumped] *emptied* into the mixing bin 22 in dry [for] *form* directly out of the bag. It is mixed to a preferred ratio of thirty percent by weight of water, and conveyed to bin 26. [Pump] *Mixing* station 12 may be powered by the conventional motor apparatus 27 and the pump output 28 is interconnected with hose 14. The workman 31 may manipulate the sprayer 16 in a variety of configurations. Workman 31A is shown within an alternative manhole 18A (FIG. 3) *spraying via hose 14A through nozzle 16A.*

Column 9, lines 47–58:

The basic brick, tile or concrete block construction 52 includes a plurality of conventional radially spaced apart bricks, [tile] *concrete tiles,* or concrete [block] *blocks* formed in layers, and separated by intermediate layers of mortar 53. The mortar thickness is ideally approximately 0.375 inches thickness. By applying cementitious mixture 24 according to the teachings of the present invention, the applicator generates a contiguous, custom, conformed liner which in effect seals the interior of the manhole against outside pressure. This application results in a liner [or] *of* a thickness approximately the thickness of the mortar 53 between adjacent bricks.

Column 9, lines 59–67:

Workmen 31 and/or 31A may begin by washing the visible manhole interior surface with high pressure spray water, so that it is properly cleaned prior to [application] *lining*. Loose brick, tile, concrete block or mortar, such as bricks 52, are chipped out and removed. When the surface has been properly treated, the cementitious mixture 24 is [pneumatically sprayed through hoses 14 or 14A, and the] *conveyed through hoses 14 or 14A to a nozzle 16A to be pneumatically dispersed and sprayed onto the surface. The* user [will apply a uniform, even coating] *spray applies the lining uniformly about the surface* until the thickness is appropriate.

Column 10, lines 19–29:

The preferred lightweight concrete mixture has a dry bulk density of between 54 lbs. to 57 lbs. per cubic feet with all additives included other than water. The cementitious mixture comprises a pair of chemically active ingredients which react with calcium hydroxide resulting from portland cement hydration to form hydrated calcium silicates which will not leach back from the final product. A de-air entraining agent for removing air from the mixture is necessary to minimize resultant liner porosity. The mixture is fiber reinforced with alkaline resistant [glass] *fiberglass* rods.

Column 11, lines 21–32:

The preferred cementitious mixture comprises twenty to forty percent water by weight. Preferably the cementitious mixture comprises approximately one to ten percent of a silicate aggregate by weight, preferably four to six percent perlite. It is preferably sixty to seventy percent Portland cement by weight, twenty to thirty percent by weight [pozzolonic] *pozzolanic* material such [a] *as* fly ash, and one-half to five percent by weight fiberglass rods for reinforcement. Two important ingredients are the silica in the perlite and the free lime in the cement, which react with the calcium hydroxide in the cement to form hydrate calcium silicates. *For example, the cementitious mixture can comprise approximately 1–10% silicate aggregate, 20–80% portland cement, 10–50% pozzolanic material, and 0.5 to 5% fiberglass rods by weight, and can preferably comprise 60–70% portland cement, 20–30% fly ash, 4–6% perlite, and 0.5 to 5% fiberglass rods by weight.*

Column 11, lines 21–32:

This manhole was [cleared] *cleaned* and prepped, with all debris washed from the walls, the lower bench, and the invert with a 1200 PSI high pressure water sprayer. All loose mortar and brick fragments were removed. Five hundred pounds of the above described cementitious mixture were used to line/reline the manhole. Three hundred pounds were applied to the surface on the first coat, filling both the void under the manhole ring and the surface [or] *of* the brick. This coat was then rough troweled to assure a good mechanical bond.

AS A RESULT OF REEXAMINATION, IT HAS BEEN DETERMINED THAT:

Claims 1–4 are cancelled.

New claims 5–50 are added and determined to be patentable.

*5. A method of lining/relining manholes to rehabilitate, reinforce and seal them in accordance with claim 1, wherein said step of spraying a monolithic cementitious mixture comprises spraying a monolithic cementitious mixture containing a hydraulic cement and between 20% and 40% water by weight of the cementitious mixture.*

*6. A method of lining/relining manholes to rehabilitate, reinforce and seal them in accordance with claim 5, wherein said monolithic cementitious mixture comprises at least 60% hydraulic cement by weight of all ingredients other than water.*

*7. A method of lining/relining manholes to rehabilitate, reinforce and seal them in accordance with claim 6, wherein said monolithic cementitious mixture has a dry bulk density between 54 pounds per cubic foot to 57 pounds per cubic foot for all ingredients other than water.*

*8. A method of lining/relining manholes to rehabilitate, reinforce and seal them in accordance with claim 6, wherein said hydraulic cement comprises portland cement.*

*9. A method of lining/relining manholes to rehabilitate, reinforce and seal them in accordance with claim 8, wherein said monolithic cementitious mixture further comprises reinforcing fibers.*

*10. A method of lining/relining manholes to rehabilitate, reinforce and seal them in accordance with claim 9, wherein said reinforcing fibers comprise alkaline resistant glass rods.*

*11. A method of lining/relining manholes to rehabilitate, reinforce and seal them in accordance with claim 10, wherein said monolithic cementitious mixture further comprises a silicate aggregate, the silicate aggregate being present in said monolithic cementitious mixture in the range of 1% to 10% by weight of all ingredients other than water.*

*12. A method of lining/relining manholes to rehabilitate, reinforce and seal them in accordance with claim 11, wherein said silicate aggregate comprises perlite.*

*13. A method of lining/relining manholes to rehabilitate, reinforce and seal them in accordance with claim 10, wherein said monolithic cementitious mixture comprises 4% to 6% perlite by weight and 0.5% to 5% alkaline resistant glass rods by weight of the ingredients of the cementitious mixture other than water.*

*14. A method of lining/relining manholes to rehabilitate, reinforce and seal them in accordance with claim 10, wherein said step of spraying a monolithic cementitious mixture comprises spraying a monolithic cementitious mixture onto the interior surfaces of the manhole without the use of forms, webbing, re-bar or mesh screens to form a continuous monolithic interior liner.*

*15. A method of lining/relining manholes to rehabilitate, reinforce and seal them in accordance with claim 14, wherein said continuous monolithic interior liner has a thickness of at least 0.375 inch.*

*16. A method of lining/relining manholes to rehabilitate, reinforce and seal them in accordance with claim 14, further comprises troweling the thus sprayed cementitious mixture prior to the step of allowing the liner to set.*

*17. A method of lining/relining manholes to rehabilitate, reinforce and seal them in accordance with claim 5, wherein said monolithic cementitious mixture further comprises a silicate aggregate, the silicate aggregate being present in said monolithic cementitious mixture in the range of 1% to 10% by weight of all ingredients other than water.*

*18. A method of lining/relining manholes to rehabilitate, reinforce and seal them in accordance with claim 13, wherein said silicate aggregate comprises perlite.*

*19. A method of lining/relining manholes to rehabilitate, reinforce and seal them in accordance with claim 5, further comprising troweling the thus sprayed cementitious mixture prior to the step of allowing the liner to set.*

*20. A method of lining/relining manholes to rehabilitate, reinforce and seal them in accordance with claim 5, wherein said monolithic cementitious mixture further comprises 10% to 50% pozzolanic material by weight of ingredients of the cementitious mixture other than water.*

*21. A method of lining/relining manholes to rehabilitate, reinforce and seal them in accordance with claim 5, wherein said continuous monolithic interior liner has a thickness of at least 0.375 inch.*

*22. A method of lining/relining manholes to rehabilitate, reinforce and seal them in accordance with claim 5, wherein said step of spraying a monolithic cementitious mixture comprises spraying a monolithic cementitious mixture onto the interior surfaces of the manhole without the use of forms, webbing, re-bar or mesh screens to form a continuous monolithic interior liner.*

*23. A method of lining/relining manholes to rehabilitate, reinforce and seal them in accordance with claim 5, wherein said step of spraying a monolithic cementitious mixture comprises spraying a monolithic cementitious mixture having a dry bulk density between 54 pounds per cubic foot to 57 pounds per cubic foot for all ingredients other than water.*

*24. A method of lining/relining manholes to rehabilitate, reinforce and seal them in accordance with claim 1, wherein said step of spraying a monolithic cementitious mixture comprises spraying a monolithic cementitious mixture having a dry bulk density between 54 pounds per cubic foot to 57 pounds per cubic foot for all ingredients other than water.*

*25. A method of lining/relining manholes to rehabilitate, reinforce and seal them in accordance with claim 24, wherein said monolithic cementitious mixture contains portland cement, silicate aggregate, pozzolanic material, reinforcing fibers, and water.*

*26. A method of lining/relining manholes to rehabilitate, reinforce and seal them in accordance with claim 1, wherein said step of spraying a monolithic cementitious mixture comprises spraying a monolithic cementitious mixture containing 60 wt % to 70 wt % portland cement, 4 wt % to 6 wt % perlite, 20 wt % to 30 wt % pozzolanic material, and 0.5 wt % to 5 wt % reinforcing fibers, based on weight of all ingredients other than water.*

*27. A method of lining/relining manholes to rehabilitate, reinforce and seal them in accordance with claim 1, wherein said monolithic cementitious mixture comprises at least 60% hydraulic cement by weight of all ingredients other than water.*

*28. A method of lining/relining manholes to rehabilitate, reinforce and seal them in accordance with claim 27, wherein said monolithic cementitious mixture contains 1% to 10% silicate aggregate by weight of all ingredients other than water.*

*29. A method of lining/relining manholes to rehabilitate, reinforce and seal them in accordance with claim 1, wherein said monolithic cementitious mixture comprises at least 60% portland cement by weight of all ingredients other than water.*

*30. A method of lining/relining manholes to rehabilitate, reinforce and seal them in accordance with claim 29, wherein said monolithic cementitious mixture contains 1% to 10% silicate aggregate by weight of all ingredients other than water.*

*31. A restored and structurally reinforced manhole in accordance with claim 3, wherein said sprayed cementitious liner is formed from a cementitious mixture having a dry bulk density of between 54 pounds per cubic foot to 57 pounds per cubic foot for all ingredients other than water.*

*32. A restored and structurally reinforced manhole in accordance with claim 3, wherein said sprayed cementitious liner comprises at least 60 wt % portland cement by weight of all ingredients other than water.*

*33. A restored and structurally reinforced manhole in accordance with claim 3, wherein said sprayed cementitious liner comprises a sprayed mixture containing 60 wt % to 70 wt % portland cement, 4 wt % to 6 wt % perlite, 20 wt % to 30 wt % pozzolanic material, and 0.5 wt % to 5 wt % reinforcing fibers, based on weight of all ingredients other than water.*

*34. A method of lining/relining manholes to rehabilitate, reinforce and seal them in accordance with claim 5, wherein said hydraulic cement comprises portland cement.*

*35. A method of lining/relining manholes to rehabilitate, reinforce and seal them in accordance with claim 34, wherein said monolithic cementitious mixture further comprises reinforcing fibers.*

*36. A method of lining/relining manholes to rehabilitate, reinforce and seal them in accordance with claim 35, wherein said reinforcing fibers comprise alkaline resistant glass rods.*

*37. A method of lining/relining manholes to rehabilitate, reinforce and seal them in accordance with claim 36, wherein said monolithic cementitious mixture further comprises a silicate aggregate, the silicate aggregate being present in said monolithic cementitious mixture in the range of 1% to 10% by weight of all ingredients other than water.*

*38. A method of lining/relining manholes to rehabilitate, reinforce and seal them in accordance with claim 37, wherein said silicate aggregate comprises perlite.*

*39. A method of lining/relining manholes to rehabilitate, reinforce and seal them in accordance with claim 36, wherein said monolithic cementitious mixture comprises 4% to 6% perlite by weight and 0.5% to 5% alkaline resistant glass rods by weight of the ingredients of the cementitious mixture other than water.*

*40. A method of lining/relining manholes to rehabilitate, reinforce and seal them in accordance with claim 36, wherein said continuous monolithic interior liner has a thickness of at least 0.375 inch.*

*41. A method of lining/relining manholes to rehabilitate, reinforce and seal them in accordance with claim 36, further comprising troweling the thus sprayed cementitious mixture prior to the step of allowing the liner to set.*

*42. A method of lining/relining manholes to rehabilitate, reinforce and seal them in accordance with claim 9, wherein said monolithic cementitious mixture further comprises reinforcing fibers.*

*43. A method of lining/relining manholes to rehabilitate, reinforce and seal them in accordance with claim 43, wherein said reinforcing fibers comprise alkaline resistant glass rods.*

*44. A method of lining/relining manholes to rehabilitate, reinforce and seal them in accordance with claim 43, wherein said monolithic cementitious mixture further comprises a silicate aggregate, the silicate aggregate being present in said monolithic cementitious mixture in the range of 1% to 10% by weight of all ingredients other than water.*

*45. A method of lining/relining manholes to rehabilitate, reinforce and seal them in accordance with claim 44, wherein said silicate aggregate comprises perlite.*

*46. A method of lining/relining manholes to rehabilitate, reinforce and seal them in accordance with claim 43, wherein said monolithic cementitious mixture comprises 4% to 5% perlite by weight and 0.5% to 5% alkaline resistant glass rods by weight of the ingredients of the cementitious mixture other than water.*

*47. A method of lining/relining manholes to rehabilitate, reinforce and seal them in accordance with claim 43, wherein said continuous monolithic interior liner has a thickness of at least 0.375 inch.*

*48. A method of lining/relining manholes to rehabilitate, reinforce and seal them in accordance with claim 43, further comprising troweling the thus sprayed cementitious mixture prior to the step of allowing the liner to set.*

*49. A method of lining/relining manholes to rehabilitate, reinforce and seal them in accordance with claim 5, wherein said monolithic cementitious mixture comprises 4% to 6% perlite by weight and 0.5% to 5% alkaline resistant glass rods by weight of the ingredients of the cementitious mixture other than water.*

*50. A restored and structurally reinforced manhole in accordance with claim 3, wherein said sprayed cementitious liner comprises at least 60 wt% hydraulic cement by weight of all ingredients other than water.*

* * * * *